US006383018B2

(12) United States Patent
Torii

(10) Patent No.: US 6,383,018 B2
(45) Date of Patent: May 7, 2002

(54) FITTING STRUCTURE OF CONNECTOR FOR BOARD

(75) Inventor: Chieko Torii, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/893,904

(22) Filed: Jun. 29, 2001

(30) Foreign Application Priority Data

Jun. 30, 2000 (JP) ..... 12-199862

(51) Int. Cl.[7] ..... H01R 13/73
(52) U.S. Cl. ..... 439/557; 439/357; 439/76.2
(58) Field of Search ..... 439/76.1, 76.2, 439/352, 357, 358, 544, 552, 553, 555, 557, 565, 575

(56) References Cited

U.S. PATENT DOCUMENTS 4,711,507 A * 12/1987 Noorily ..... 439/292
4,869,675 A * 9/1989 Ogawa ..... 439/76.2
4,909,745 A * 3/1990 Hayashi ..... 439/76.2
5,575,673 A * 11/1996 Dahlem et al. ..... 439/248
6,065,983 A * 5/2000 Norizuki et al. ..... 439/157
6,257,925 B1 * 7/2001 Jones ..... 439/557
6,280,246 B1 * 8/2001 Sawayanagi ..... 439/567

* cited by examiner

*Primary Examiner*—Tulsidas Patel
(74) *Attorney, Agent, or Firm*—Finnegan, Henderson, Farabow, Garrett, & Dunner, L.L.P.

(57) ABSTRACT

Engaging arms 47 are provided on widthwise opposite sides of a board connector 39 mounted on a wiring board 19. A tip end of each of the engaging arm 47 is fixed to the wiring board 19 by solder 49. The wiring board 19 is accommodated in a equipment case 17. A mating connector 51 is inserted from a through hole 17*b* formed in the equipment case 17 and fitted into the board connector 39. Engaging projections 51*a* are provided on widthwise opposite sides of the mating connector 51, and engaged with the engaging holes 47*c* formed in the engaging arms 47 and locked and fixed thereto. Hoods 17*c* projecting toward the wiring board 19 are formed on the through holes 17*b* of the equipment case 17. Lock-releasing levers 53 for releasing the rock between the engaging projections 51*a* and the engaging holes 47*c* are provided on the hoods 17*c*.

5 Claims, 6 Drawing Sheets

FITTING STRUCTURE OF CONNECTOR FOR BOARD

BACKGROUND OF THE INVENTION

1. Field of the Invention

The present invention relates to a fitting structure of a connector for a board in which the board connector is mounted to a wiring board, and a mating connector is fitted to the board connector through a hood provided on an equipment case in which the wiring board is accommodated.

2. Description of the Earlier Art

A proposed connector coupling mechanism will be explained based on FIGS. 1 to 3.

FIG. 1 shows a state in which a board connector 5 is mounted to a wiring board 3 accommodated in a meter case 1. FIG. 2 is a perspective view of the board connector 5 and a mating connector 7 fitted to the board connector 5.

The board connector 5 comprises a housing 9 and a male terminal 11. In a state in which a tip end opening of the housing 9 is fitted into a through hole 3*a* formed in the wiring board 3, an end of the male terminal 11 pulled out from the housing 9 passes through the wiring board 3 and is fixed to a conductive portion by solder 13.

The meter case 1 is formed with a through hole 1*a* corresponding to the through hole 3*a*. The through hole 1*a* is formed with a hood 1*b* projecting leftward in the drawings such as to cover a periphery of a tip end of the housing 9.

A projection-forming portion 15 on the mating connector 7 is a lock-releasing lever, and includes an engaging projection 15*a*. The housing 9 is formed with an engaging hole 9*a* with which the engaging projection 15*a* engages.

If the mating connector 7 is fitted into the board connector 5 through the hood 1*b* of he meter case 1 from the state shown in FIG. 1, the engaging projection 15*a* is inserted into and engaged with the engaging hole 9*a* as shown in FIG. 3, and both the connectors 5 and 7 are locked and fixed to each other. At that time, a portion of the mating connector 7 is projected from the through hole 1*a* of the meter case 1.

When the mating connector 7 is detached from the board connector 5, a portion of the mating connector 7 projecting from the meter case 1 is picked to resiliently deform the lock-releasing lever 15, and the lever 15 is pulled out in a state in which engagement of the lock-releasing lever 15 with respect to the engaging hole 9*a* of the engaging projection 15*a* is released.

In the above-described conventional fitting structure of the board connector, when the mating connector 7 is detached from the board connector 5, it is necessary to pick the end of the mating connector 7 so as to resiliently deform the lock-releasing lever 15. Therefore, the height H of the mating connector 7 is formed relatively long so that the mating connector 7 projects from the meter case 1, and since the mating connector 7 includes the lock-releasing lever 15, its structure is complicated, which also increase costs of the connector.

SUMMARY OF THE INVENTION

It is an object of the present invention to prevent a mating connector to be fitted into a board connector from being increased in height and from being complicated.

To achieve the above object, according to a first aspect of the invention, there is provided a fitting structure of a connector, comprising a equipment case, a wiring board accommodated in a bottom in the equipment case, a first connector mounted on the opposite side from the bottom, a second connector fitted to the first connector through a hood provided on the bottom, an engaging arm of the first connector having a movable-side engaging portion which is engaged with a fixed-side engaging portion provided on the second connector, and a lock-releasing lever for displacing the engaging arm such as to release the engagement between the fixed-side engaging portion and the movable-side engaging portion, the lock-releasing lever being operable from outside the equipment case.

According to the fitting structure of the board connector, if the mating connector is fitted into the board connector through the hood of the equipment case, the fixed-side engaging portion of the mating connector is engaged with the movable-side engaging portion of the board connector, thereby rocking and fixing both the connectors to each other. When the mating connector is to be detached from board connector, a finger of an operator is inserted into a play around an outer periphery of the lock-releasing lever to operate the lock-releasing lever for displacing the engaging arm and with this operation, the engagement between the fixed-side engaging portion and the movable-side engaging portion is released.

With the above arrangement, it is unnecessary to project a portion of the connector from a surface of the bottom of the equipment case in the fitted state, and it is possible to prevent the height of the connector from being increased to lower the connector, the structure is simplified, and costs of the connector can be reduced.

According to a second aspect of the invention, in the first aspect, the engaging arm is disposed on each of left and right side as viewed from an insertion direction of the mating side. If the mating connector is inserted into the board connector, fixed-side engaging portions of the mating connector are respectively engaged with the pair of engaging arms on the left and right opposite sides of the board connector.

With this arrangement, both the connectors can reliably locked and fixed to each other.

According to a third aspect of the invention, in the first aspect, a base end of the engaging arm is fixed to a bottom on the opposite side from the wiring board, and a tip end of the engaging arm is fixed to the wiring board, the lock-releasing lever is located inside of the engaging arm to displace the engaging arm outward. With this arrangement, from a state in which the mating connector is fitted into the board connector, if the lock-releasing levers on the opposite sides are operated to displace the engaging arms outward, the engagement between the fixed-side engaging portions and the movable-side engaging portions is released.

According to a fourth aspect of the invention, in the first aspect, the engaging arm is made of metal plate which can be resiliently deformed. With this arrangement, if the lock-releasing levers are operated, the engaging arms are easily resiliently deformed to release the engagement between the fixed-side engaging portions and the movable-side engaging portions.

According to a fifth aspect of the invention, in the fourth aspect, the movable-side engaging portion comprises an engaging hole provided on the metal plate, the fixed-side engaging portion comprises an engaging projection which can enter the engaging hole. If the mating connector is fitted into the board connector through the hood of the case, the engaging projection of the mating connector is slid into the engaging hole of the engaging arm of the board connector so that both the connectors are locked and fixed to each other.

DESCRIPTION OF THE PREFERRED EMBODIMENT

An embodiment of the fitting structure of the board connector will be explained based on the drawings below.

Figure 1:
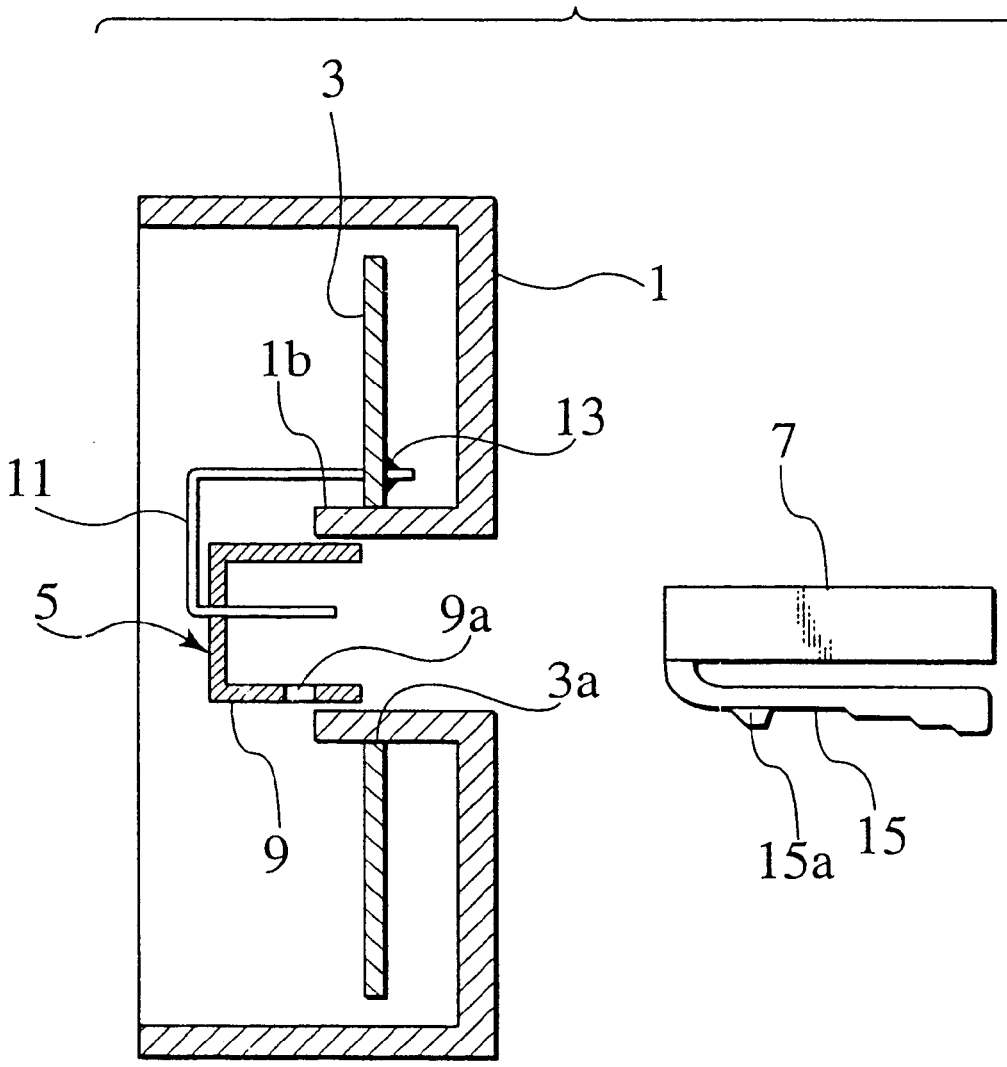
FIG.1 PRIOR ART
FIG. 1 is a sectional view showing a fitting structure of a proposed board connector.
Figure 2:
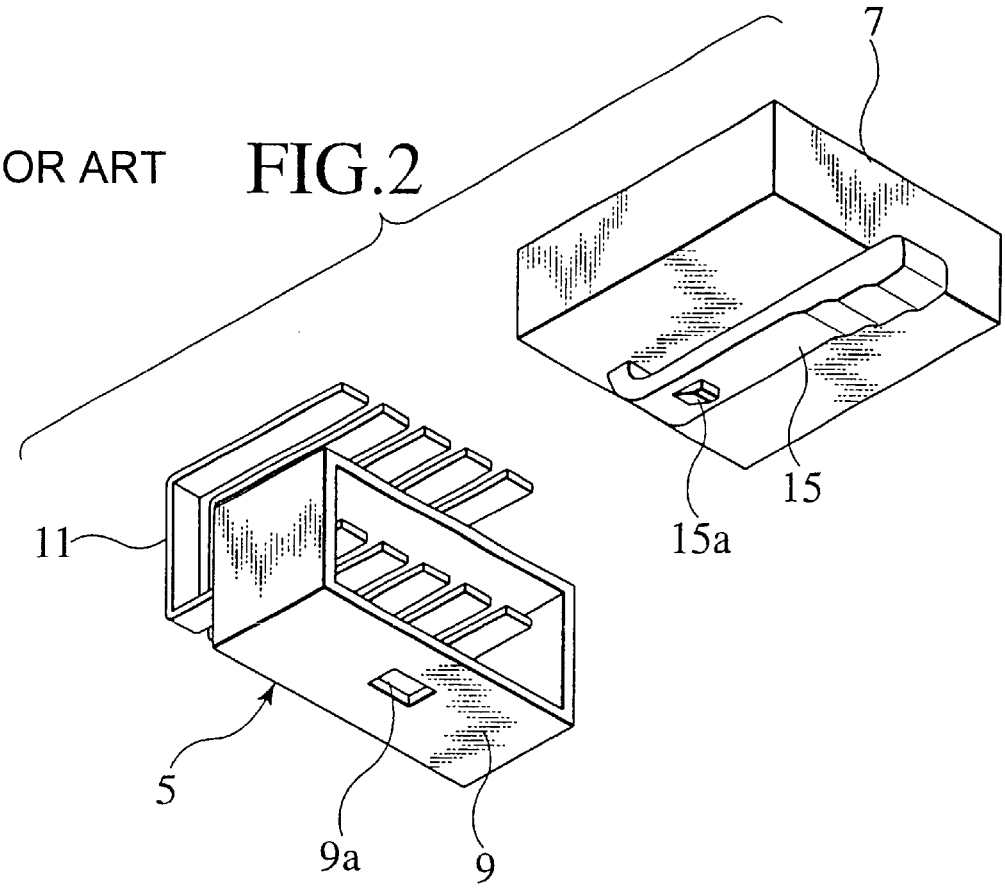
PRIOR ART FIG.2
FIG. 2 is a perspective view of the board connector and a mating connector shown in FIG. 1.
Figure 3:
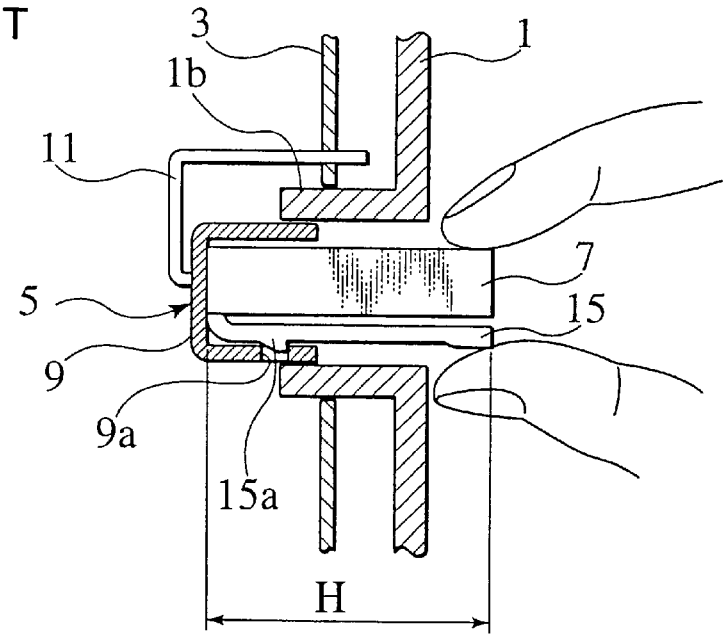
FIG.3 PRIOR ART
FIG. 3 is a sectional view showing a state in which the mating connector shown in FIG. 1 is fitted into the board connector.
Figure 4:
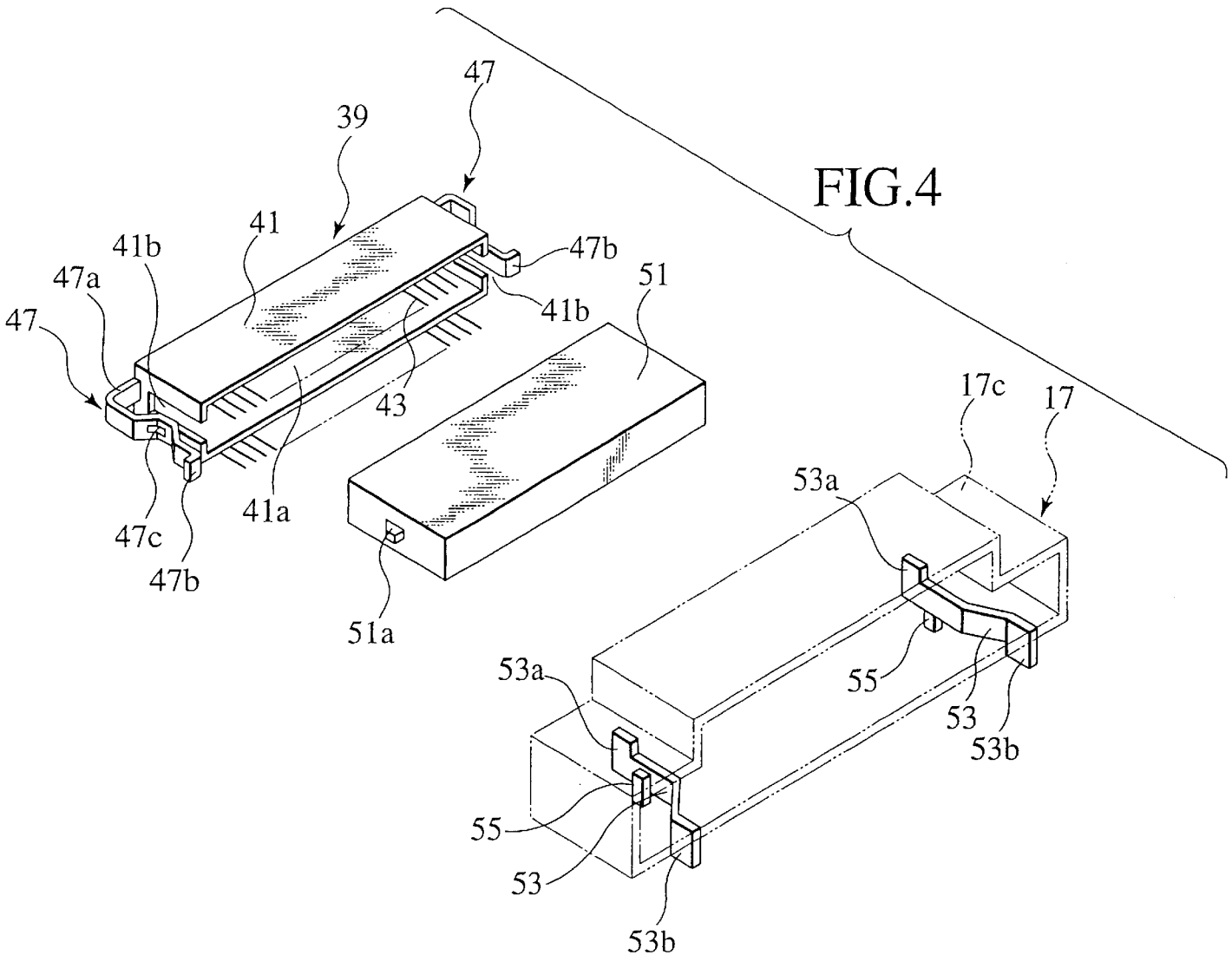
FIG. 4 is an exploded perspective view of the fitting structure of the board connector according to an embodiment of the invention.
Figure 5:
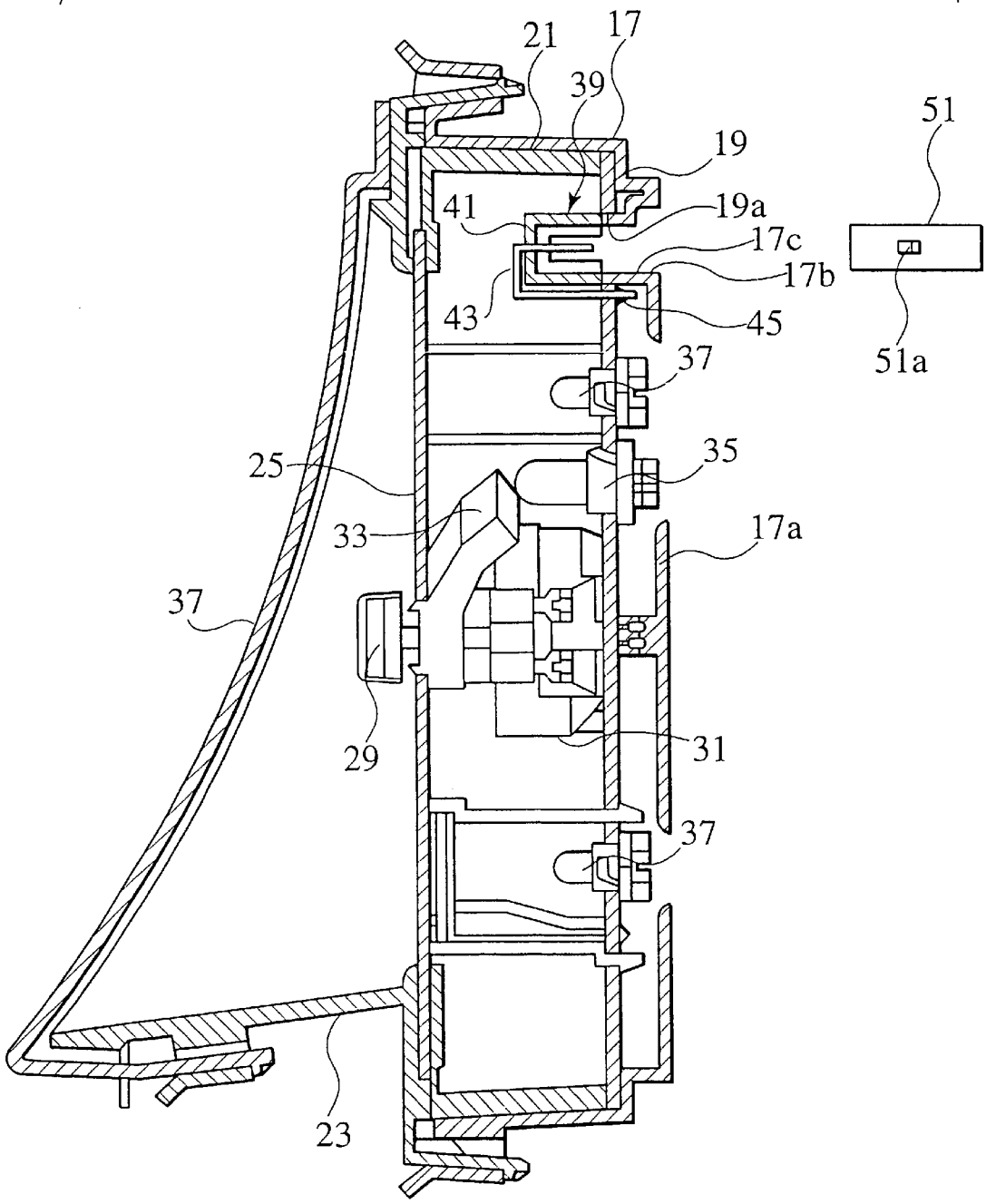
FIG. 5 is a sectional view of an automobile measuring instrument having the fitting structure of the board connector shown in FIG. 4.

FIG. 4 is an exploded perspective view of the fitting structure of the board connector according to an embodiment of the invention, and FIG. 5 is a sectional view of an automobile measuring instrument having the fitting structure of the board connector.

A wiring board 19 is accommodated in a bottom 17*a* of a meter case 17 as equipment case. The wiring board 19 is sandwiched between the bottom 17*a* and a fixing plate 21 accommodated in the meter case 17. The fixing plate 21 is fixed by a flyleaf 23 mounted such as to cover an opening formed in a front surface of the meter. A character face 25 is provided between the flyleaf 23 and the fixing plate 21. A surface glass 27 is mounted to a front opening of the flyleaf 23.

Mounted to the wiring board 19 are a movement 31 for rotating an index needle 29, an illumination bulb 35 for supplying light to a light-introducing plate 33 for illuminating the index needle 29 and the character face 25, and an illumination bulb 37 for illuminating a design portion on the character face 25 such as warning display. In FIG. 5, a board connector (first connector) 39 is mounted to an upper portion of the wiring board 19 in FIG. 5 on the opposite side from the bottom 17*a*. A housing 41 of a board connector 39 includes a front opening 41*a* corresponding to the a through hole 19*a* of the wiring board 19, and side openings 41*b* formed in longitudinally opposite sides of the housing 41. A male terminal 43 fixed to the housing 41 is pulled out from the housing 41, and the pulled out end of the male terminal 43 is fixed to a conductive portion on the wiring board 19 by solder 45.

Figure 6:
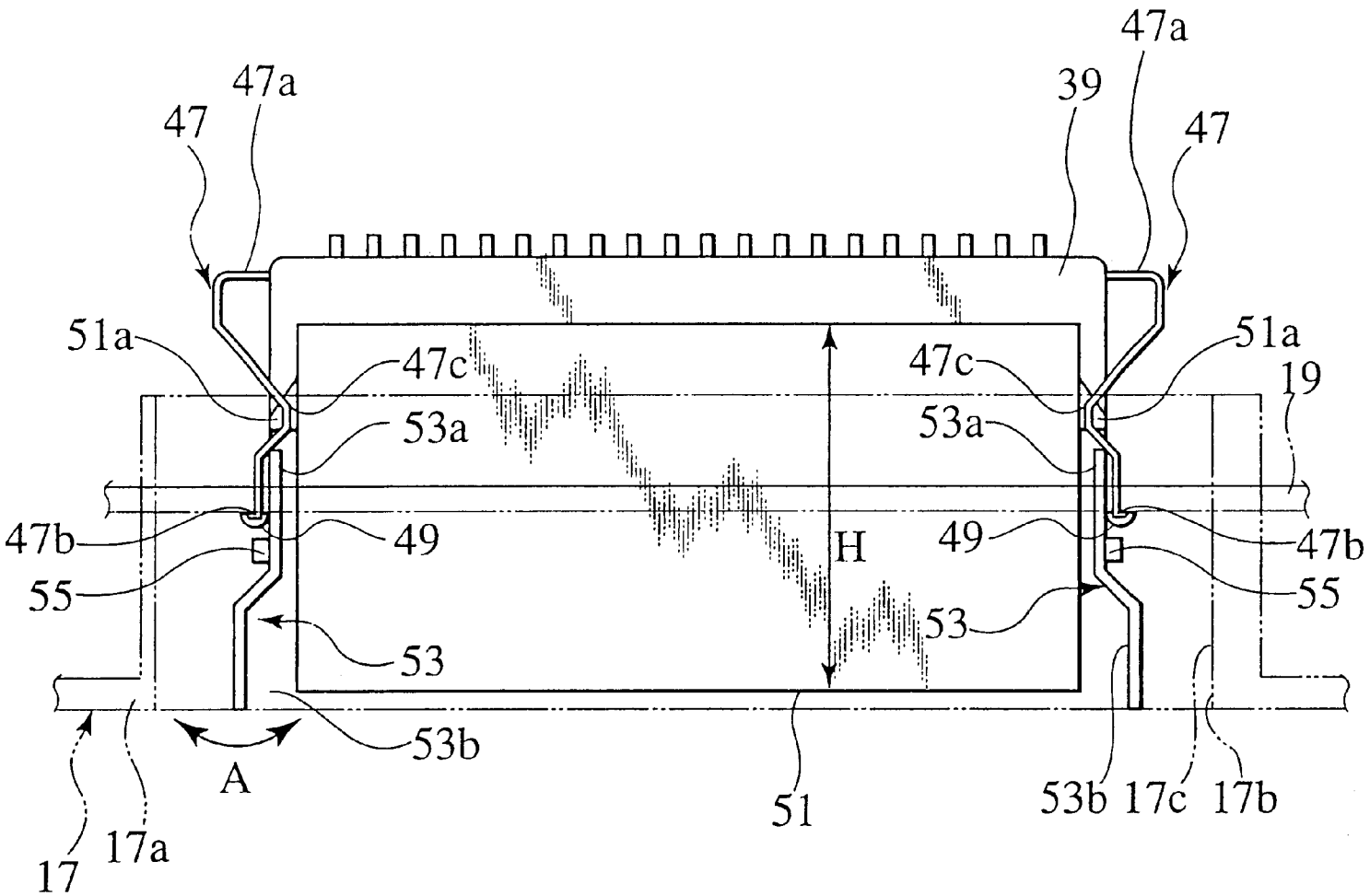
FIG. 6 is a view showing a state in which the mating connector in the fitting structure of the board connector is fitted to the board connector.

Engaging arms 47 are provided on longitudinally opposite sides of the housing 41, i.e., on left and right opposite sides of the housing 41 as viewed from an inserting side of a mating connector 51 (which will be described later) into the board connector 39. Each of the engaging arms 47 is formed by bending a metal plate. Each of the engaging arms 47 is provided with a fixing portion 47*a* closer to a base end of the arm 47. The fixing portion 47*a* is fixed to the housing 41 near its bottom on the opposite side from the wiring board 19. The engaging arm 47 is also provided at its tip end with a holding portion 47*b*. The holding portion 47*b* passes through the wiring board 19 and is fixed to the wiring board 19 by solder 49 as shown in FIG. 6. FIG. 6 shows a state in which the mating connector (second connector) 51 is fitted into the board connector 39.

Each of the engaging arms 47 is bent such that its central portion projects toward the housing 41. An engaging hole 47*c* as a moving-side engaging portion is formed near this bent portion. On the other hand, the mating connector 51 fitted into the board connector 39 has a female terminal therein into which the male terminal 43 of the board connector 39 is to be fitted. The mating connector 51 is provided at its longitudinally opposite sides with engaging projections 51*a* as fixed-side engaging portions capable of entering into the engaging holes 47*c* of the board connector 39 and engaging therewith.

A through hole 17*b* is formed in the bottom 17*a* of the meter case 17 at a position corresponding to the board connector 39. A hood 17*c* is formed on the through hole 17*b* such as to project toward the board connector 39.

Each of the hoods 17*c* is provided at its portion corresponding to the engaging arm 47 with a lock-releasing lever 53 for releasing the engagement between the engaging hole 47*c* of the engaging arm 47 and the engaging projection 51*a* of the mating connector 51. A substantially central portion of each of the lock-releasing levers 53 in its longitudinal direction is fixed to the hood 17*c* by means of a support portion 55 such that the lock-releasing lever 53 can rock around the support portion 55 in a direction of the arrow A in FIG. 6. The lock-releasing lever 53 and the engaging arm 47 are omitted in FIG. 5.

As shown in FIG. 6, an operation-side end 53*a* of the lock-releasing lever 53 on the side of the board connector 39 is located closer to the support portion 55 than the engaging hole 47*c*. On the other hand, an operation-side end 53*b* on the opposite side is exposed to the through hole 17*b* of the meter case 17 as shown in FIG. 7 which is a perspective view as viewed from the bottom 17*a* of the meter case 17.

Figure 7:
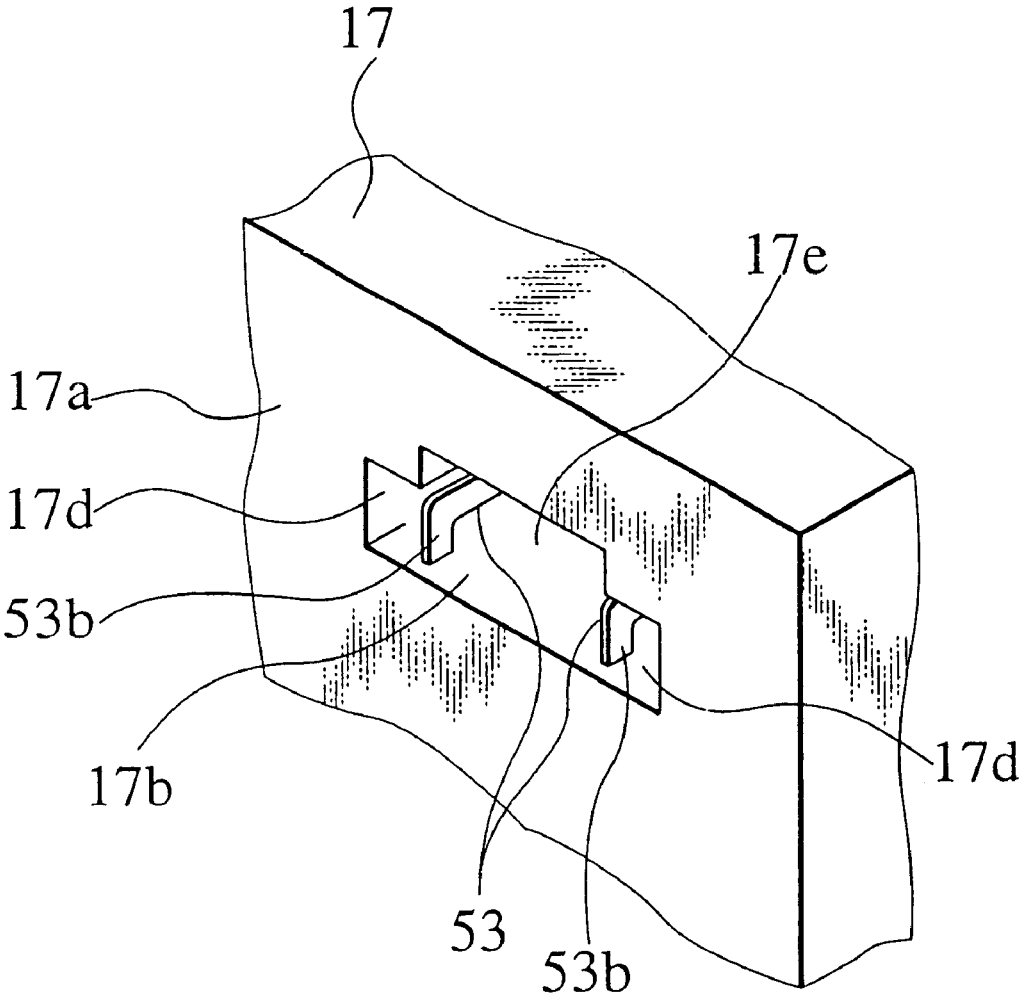
FIG. 7 is a perspective view as viewed from a bottom side of a measuring case in the fitting structure of the board connector shown in FIG. 4.

As shown in FIG. 7, the through hole 17*b* is provided, outside the lock-releasing lever 53, with an operation region 17*d* into which a finger of an operator is inserted when the operator operates the lock-releasing lever 53. The through hole 17*b* is also provided at its upper portion with an operation region 17*e* into which the finger of the operator is inserted so as to pull out the mating connector 51 after the lock is released. In a state in which the mating connector 51 is fitted into the board connector 39, the through hole 17*b* is formed at its lower portion opposite from the operation region 17*e* with another operation region into which the finger of the operator is inserted between the mating connector 51 and the hood 17*c*. That is, when the mating connector 51 is pulled out from the hood 17*c*, upper and lower opposite surfaces are picked.

If the mating connector 51 is fitted into the board connector 39 through the hood 17*c* of the meter case 17 from the state shown in FIG. 5, the engaging projection 51*a* enters and engages the engaging hole 47*c* of the engaging arm 47. With this operation, both the connectors 51 and 39 are locked and fixed to each other. In a state in which the mating connector 51 is fitted into the board connector 39, as shown in FIG. 6, a height H of the mating connector 51 is set such that the mating connector 51 is substantially flush with a surface of the bottom 17*a* of the meter case 17.

From the locked and fixed state, if the operation-side ends 53*b* of the pair of lock-releasing levers 53 exposed from the through holes 17*b* of the meter cases 17 are moved in their approaching direction as shown in FIG. 7, each of the lock-releasing lever 53 rocks around the support portion 55, and with this movement, the operation-side end 53*a* outwardly displaces the central portion having the engaging arm 47*c* of the engaging arm 47 so that the engagement between the engaging projection 51*a* and the engaging hole 47*c* is released. In this state, if the mating connector 51 is pulled out from the hood 17*c* by picking the mating connector 51 from above and below, the mating connector 51 can be detached from the board connector 39.

According to the above-described fitting structure of the board connector, since the hood 17*c* of the meter case 17 is provided with the lock-releasing lever 53 for releasing the locked and fixed state in the engaged state of the board connector 39 and the mating connector 51, it is unnecessary to project a portion of the mating connector 51 from the surface of the bottom 17*a* of the meter case 17 in the fitted state. Therefore, the height H can be reduced to lower the entire height, and since it is unnecessary to provide a lock-releasing lever, the structure is simplified, and costs of the connector can be reduced.

What is claimed is:

1. A fitting structure of a connector, comprising a equipment case, a wiring board accommodated in a bottom in the equipment case, a first connector mounted on the opposite side from the bottom, a second connector fitted to the first connector through a hood provided on the bottom, an engaging arm of the first connector having a movable-side engaging portion which is engaged with a fixed-side engaging portion provided on the second connector, and a lock-releasing lever for displacing the engaging arm such as to release the engagement between the fixed-side engaging portion and the movable-side engaging portion, the lock-releasing lever being operable from outside the equipment case.

2. A fitting structure of a connector according to claim 1, wherein the engaging arm is disposed on each of left and right side as viewed from an insertion direction of the mating side.

3. A fitting structure of a connector according to claim 1, wherein a base end of the engaging arm is fixed to a bottom on the opposite side from the wiring board, and a tip end of the engaging arm is fixed to the wiring board, the lock-releasing lever is located inside of the engaging arm to displace the engaging arm outward.

4. A fitting structure of a connector according to claim 1, wherein the engaging arm is made of metal plate which can be resiliently deformed.

5. A fitting structure of a connector according to claim 4, wherein the movable-side engaging portion comprises an engaging hole provided on the metal plate, the fixed-side engaging portion comprises an engaging projection which can enter the engaging hole.

* * * * *

UNITED STATES PATENT AND TRADEMARK OFFICE

CERTIFICATE OF CORRECTION

PATENT NO. : 6,383,018 B2
DATED : May 7, 2002
INVENTOR(S) : Chieko Torii

It is certified that error appears in the above-identified patent and that said Letters Patent is hereby corrected as shown below:

Title page,
Item [57], ABSTRACT,
Line 13, “rock” should read -- lock --.

Signed and Sealed this

Tenth Day of September, 2002

*Attest:*

*Attesting Officer*

JAMES E. ROGAN
*Director of the United States Patent and Trademark Office*